US010569541B2

(12) United States Patent
Watanabe

(10) Patent No.: US 10,569,541 B2
(45) Date of Patent: Feb. 25, 2020

(54) LIQUID EJECTION HEAD

(71) Applicant: CANON KABUSHIKI KAISHA, Tokyo (JP)

(72) Inventor: Shinichiro Watanabe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/198,502

(22) Filed: Nov. 21, 2018

(65) Prior Publication Data

US 2019/0160814 A1 May 30, 2019

(30) Foreign Application Priority Data

Nov. 28, 2017 (JP) ..... 2017-227970

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1628* (2013.01); *B41J 2002/14241* (2013.01); *B41J 2002/14491* (2013.01)

(58) Field of Classification Search
CPC ..... B41J 2/14233; B41J 2002/14241; B41J 2002/14491
See application file for complete search history.

(56) References Cited

U.S. PATENT DOCUMENTS

2006/0290747 A1* 12/2006 Shimada ..... B41J 2/14233 347/68

FOREIGN PATENT DOCUMENTS

JP 2004358796 A 12/2004

* cited by examiner

*Primary Examiner* — Geoffrey S Mruk
(74) *Attorney, Agent, or Firm* — Canon U.S.A., Inc. IP Division

(57) ABSTRACT

A liquid ejection head includes a first substrate and a second substrate. The first substrate includes a pressure chamber communicating with an ejection port that ejects liquid, a diaphragm that forms part of a wall constituting the pressure chamber, and at least one piezoelectric element configured to generate energy for displacing the diaphragm to eject liquid through the ejection port. The second substrate has a cavity containing the piezoelectric element. The first substrate and the second substrate are joined together with an adhesive. A liquid repellent portion surrounding the piezoelectric element is disposed on a surface of the first substrate where the piezoelectric element is disposed.

11 Claims, 3 Drawing Sheets

LIQUID EJECTION HEAD

BACKGROUND OF THE DISCLOSURE

Field of the Disclosure

The present disclosure relates to a liquid ejection head formed by laminating a plurality of substrates.

Description of the Related Art

Inkjet printing apparatuses that eject ink to print images on a printing medium generally include a liquid ejection head that ejects ink. A known mechanism for ejecting ink with the liquid ejection head uses a pressure chamber whose capacity can be contracted by a piezoelectric element. In this mechanism, the pressure chamber is contracted due to deformation of the piezoelectric element to which a voltage is applied, so that the ink in the pressure chamber is ejected from an ejection port formed at one end of the pressure chamber. A method for manufacturing the liquid ejection head includes a method of laminating the substrates with an adhesive.

Japanese Patent Laid-Open No. 2004-358796 discloses a liquid ejection head including a channel formed substrate in which pressure generation chambers, piezoelectric elements, and electrodes are formed and a joined substrate joined to a surface of the channel formed substrate adjacent to the piezoelectric elements. The liquid ejection head disclosed in Japanese Patent Laid-Open No. 2004-358796 includes a plurality of lead-out wires each having a side connecting to a side of each piezoelectric element. Part of the lead-out wires intersect and is joined at the joined area between the joined substrate and the channel formed substrate. At the joining, the adhesive flows along the side of the lead-out wire, so that at least the side of the piezoelectric layer is covered with the adhesive.

Covering the side of the piezoelectric layer with the adhesive prevents destruction of the piezoelectric elements caused by an external environment, enhancing the voltage resistance of the piezoelectric elements. This also prevents cracking of portions of the diaphragm corresponding to corners formed by the sides of the piezoelectric elements and the diaphragm, and even if cracks are formed, the cracks can be sealed by the adhesive covering the piezoelectric elements.

However, in the method disclosed in Japanese Patent Laid-Open No. 2004-358796, it is difficult to uniformly cover the sides of the piezoelectric elements. Furthermore, the amount of the adhesive covering the piezoelectric elements tends to vary. The variation in the amount of the adhesive on the sides of the piezoelectric elements causes uneven hardness of the diaphragm, causing the driving of the piezoelectric elements to vary.

SUMMARY OF THE DISCLOSURE

The present disclosure provides a liquid ejection head in which the characteristics of the piezoelectric elements are not deteriorated even if the substrates are joined with an adhesive, so that the piezoelectric elements can be densely arranged with less variation in driving.

The present disclosure provides a liquid ejection head including a first substrate and a second substrate. The first substrate includes a pressure chamber communicating with an ejection port that ejects liquid, a diaphragm that forms part of a wall constituting the pressure chamber, and at least one piezoelectric element configured to generate energy for displacing the diaphragm to eject liquid through the ejection port. The second substrate has a cavity containing the piezoelectric element. The first substrate and the second substrate are joined together with an adhesive. A liquid repellent portion surrounding the piezoelectric element is disposed on a surface of the first substrate where the piezoelectric element is disposed.

Further features and aspects of the present disclosure will become apparent from the following description of exemplary embodiments with reference to the attached drawings.

DESCRIPTION OF THE EMBODIMENTS

Numerous example embodiments and various aspects of the present disclosure will be described hereinbelow with reference to the drawings.

First Example Embodiment

Figure 1A:
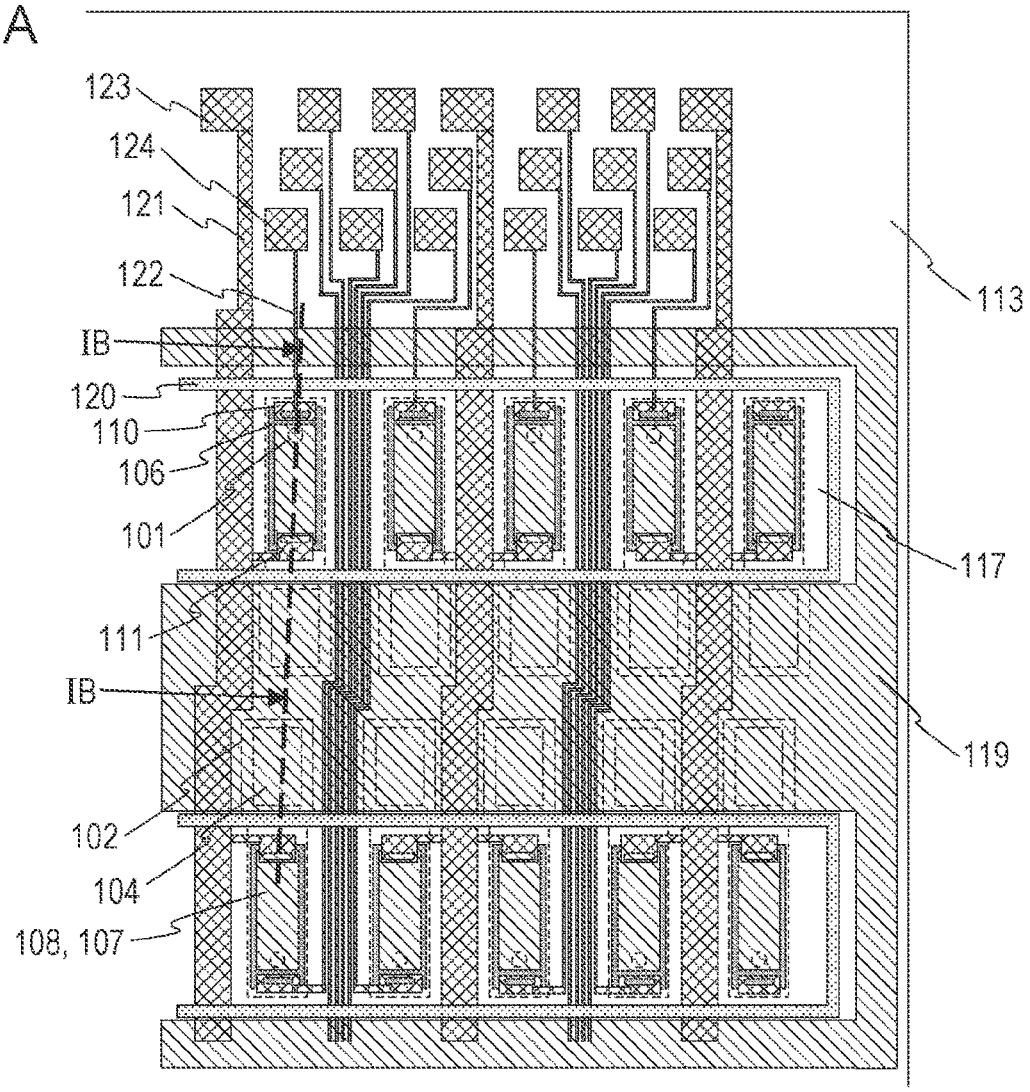
FIG. 1A is a plan view of a liquid ejection head according to a first example embodiment of the present disclosure.
Figure 1B:
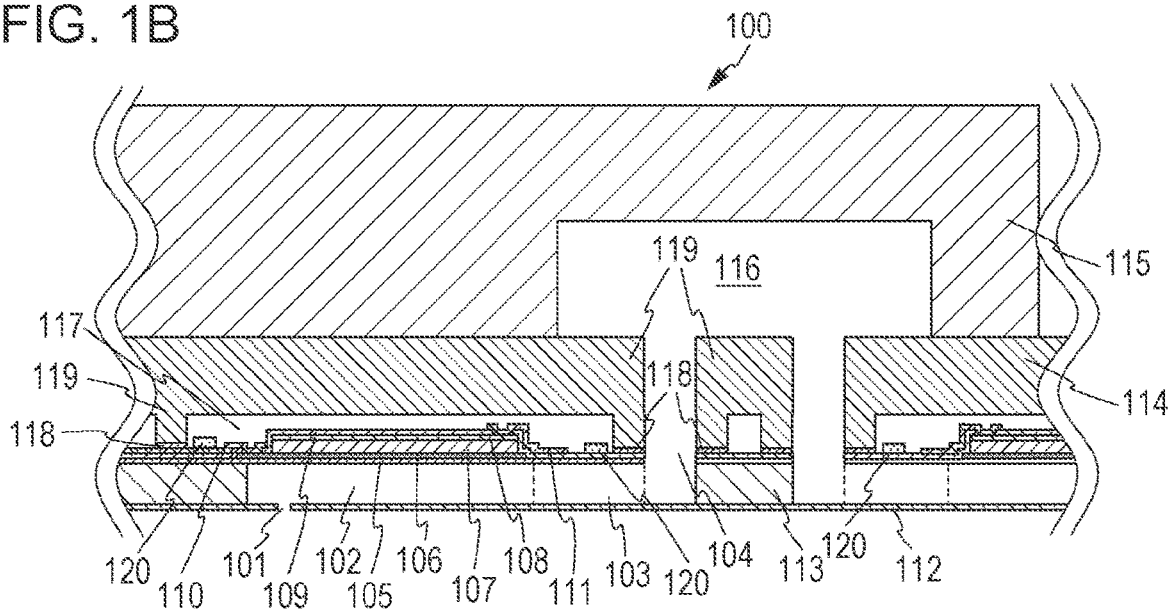
FIG. 1B is a cross-sectional view taken along line IB-IB in FIG. 1A.

FIG. 1A is a plan view of a liquid ejection head (also referred to as "inkjet head") 100 that ejects liquid, such as ink, according to a first embodiment of the present disclosure. FIG. 1B is a cross-sectional view taken along line IB-IB in FIG. 1A illustrating the periphery of a pressure chamber 102 of the inkjet head 100. The first example embodiment will be described with reference to FIG. 1A and FIG. 1B.

The inkjet head 100 according to the first example embodiment of the present disclosure includes an ejection port substrate 112 including ejection ports 101, a first substrate 113 including pressure chambers 102, a second substrate 114 including cavities 117, and an ink supply substrate 115 that supplies ink to each pressure chamber 102. The cavities 117 each contain piezoelectric elements 107. A diaphragm 105 is disposed on the first substrate 113. The pressure chambers 102 are disposed on one side of the first substrate 113, and a driving layer is disposed on the other side. The driving layer formed on the diaphragm 105 includes a lower electrode layer 106, piezoelectric elements 107, and an upper electrode layer 108 and is covered with a protection film 109.

The protection film 109 has openings in each of which an individual lead-out electrode 110 that leads out an electrode from the lower electrode layer 106 and a common lead-out electrode 111 that leads out an electrode from the upper electrode layer 108 are formed. Each individual lead-out electrode 110 is connected to an individual lead-out wire 122 and is then electrically connected to an individual mounting terminal 124. Each common lead-out electrode 111 is connected to a common lead-out wire 121 and is then electrically connected to a common mounting terminal 123. Driving signals input through the individual mounting terminal 124 include an ejection port selection signal for selecting an ejection port 101 to be used, an ejection-driving waveform signal for driving the piezoelectric element 107 that generates ejection energy for ejection, and a non-ejection driving waveform signal for vibrating the meniscus for recovery without ejecting the ink.

Although FIG. 1A illustrates only part of the inkjet head 100, one inkjet head 100 includes about 1,000 pressure chambers and ejection ports, allowing 1,200 dpi printing.

The first substrate 113 and a junction 119 of the second substrate 114 including the cavities 117 are joined with an adhesive 118. The cavities 117 above the plurality of piezoelectric elements 107 are common to the plurality of piezoelectric elements 107 aligned in a lateral row. The adhesive 118 may be a negative photoresist SU-8 3000 series manufactured by Nippon Kayaku Co., Ltd., benzocyclobutene (BCB) Cyclotene series manufactured by Dow Chemical Company, or a one-part or two-part thermosetting resin.

An example of a method for forming the adhesive 118 is a method of applying the adhesive 118 to the entire surface of the first substrate 113 by spin coating or the like and then exposing and developing the adhesive 113. An example a method for non-photosensitive BCB is a method of applying the BCB to the entire surface by spin coating or the like, patterning a photoresist to form a mask, and then patterning the BCB by reactive ion etching (RIE) using a $CF_4/O_2$ gas using the mask. For a one-part or two-part thermosetting resin, the adhesive 118 may be applied to the junction 119 of the second substrate 114 using a transfer method using flexo printing.

Since there is no structure that restricts longitudinal displacement of the diaphragm 105 in a region 103 between the pressure chamber 102 and an ink channel 104, a portion of the junction 119 adjacent to the ink channel 104 serves as a diaphragm holding unit that restricts the deformation of the diaphragm 105.

The ink supplied through an ink supply channel 116 formed in the ink supply substrate 115 passes through the second substrate 114 and the ink channel 104 formed by the junction 119 that joins the second substrate 114 and the first substrate 113 into the pressure chamber 102.

The first substrate 113 including the plurality of piezoelectric elements 107 and the junction 119 of the second substrate 114 are joined via the adhesive 118. Between the plurality of piezoelectric elements 107 and the junction 119, a liquid repellent portion 120 made of a material that repels the adhesive 118 is formed so as to surround the plurality of piezoelectric elements 107.

To densely disposing the pressure chambers 102 of the inkjet head 100, the distance between the piezoelectric elements 107 and the junction 119 needs to be as small as possible, so that the distance is set very small, for example, 15 μm. The liquid repellent portion 120 is formed with a compound containing fluorine atoms by spin coating, dipping, vacuum deposition, or another deposition method. The thickness of the liquid repellent portion 120 need only be smaller than the distance between the piezoelectric elements 107 and the junction 119, for example, 5 to 10 μm, in consideration of the alignment and accuracy of the joining. The liquid repellent portion 120 has a thickness of 0.1 nm to 15 μm, for example, 50 nm. Since the distance between the piezoelectric elements 107 and the junction 119 is thus small, the piezoelectric elements 107 are nonuniformly covered by an excessive adhesive flowing out of the junction 119 during the joining, making the hardness of the diaphragm 105 uneven to cause the driving of the piezoelectric elements 107 to vary.

However, forming the liquid repellent portion 120 around the plurality of piezoelectric elements 107 as in the first embodiment prevents the excessive adhesive during the joining from reaching the piezoelectric elements 107. Thus, the present embodiment allows the pressure chambers 102 to be densely disposed and reduces variations in the driving of the piezoelectric elements 107.

Second Example Embodiment

Figure 2:
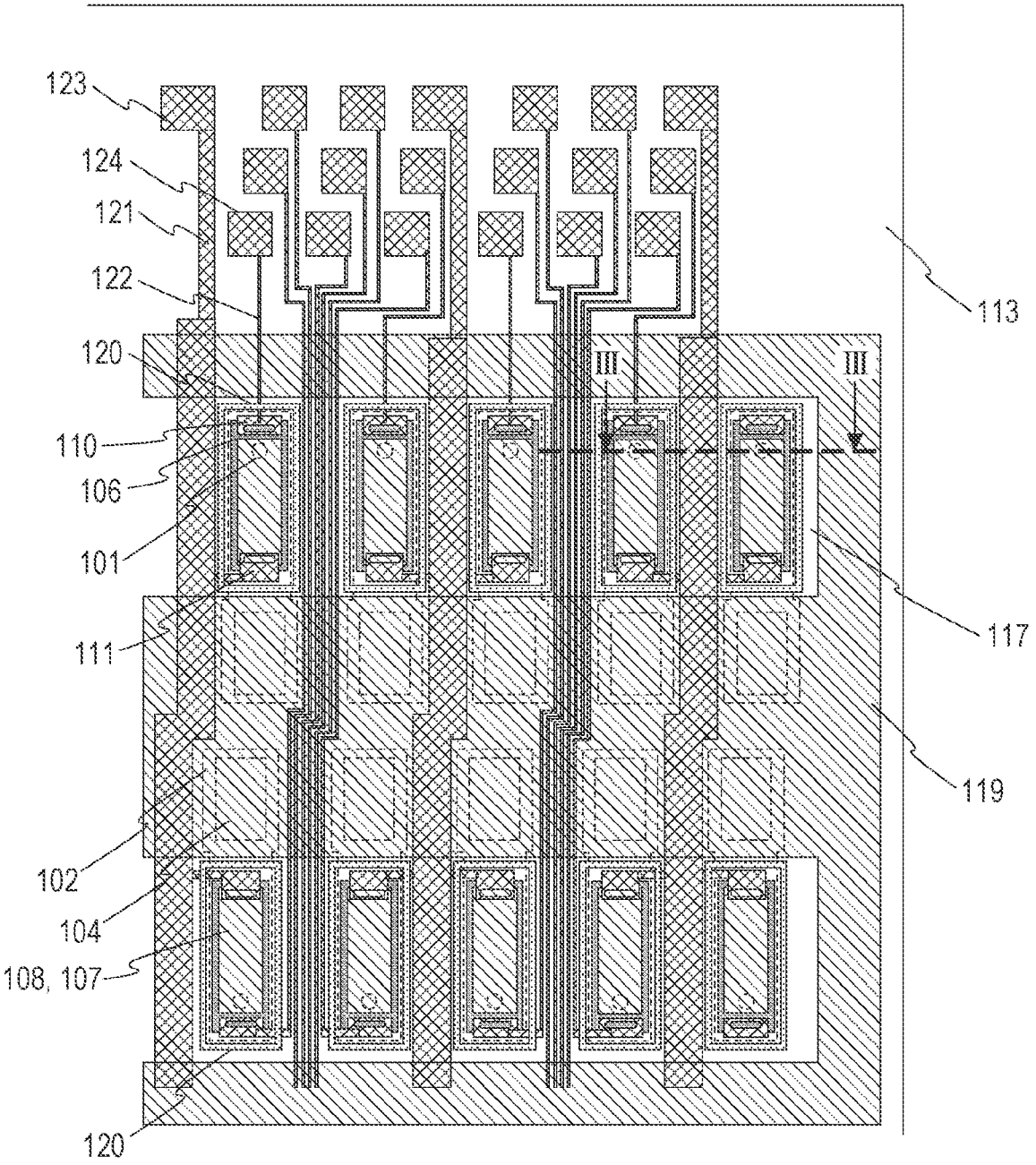
FIG. 2 is a plan view of a liquid ejection head according to a second example embodiment of the present disclosure.

A second example embodiment will be described with reference to FIG. 2. FIG. 2 is a plan view of a liquid ejection head according to the second embodiment. In the second embodiment, the liquid repellent portion 120 is formed so as to surround each of the piezoelectric elements 107. Even if a problem occurs in part of the liquid repellent portion 120, the peripheries of the piezoelectric elements 107 other than a piezoelectric element 107 corresponding to the part are individually surrounded by the liquid repellent portion 120. This prevents the leaked adhesive from influencing the other piezoelectric elements 107, further reducing variations in the driving of the piezoelectric elements 107.

Furthermore, the liquid repellent portion 120 can be formed also on the individual lead-out electrodes 110 and the common lead-out electrodes 111, so that the adjacent pressure chambers 102 can be arranged at necessary minimum intervals. This allows the pressure chambers 102 to be densely disposed and reduces variations in the driving of the piezoelectric elements 107.

In the second embodiment, each cavity 117 is a communicating cavity in the lateral row. This is given for mere illustrative purposes. Even if the junction 119 is formed around each pressure chamber 102, the liquid repellent portion 120 can be formed around the piezoelectric elements 107. This configuration can also reduce an influence on the other piezoelectric elements 107, reducing variations in the driving of the piezoelectric elements 107.

Third Example Embodiment

Figure 3:
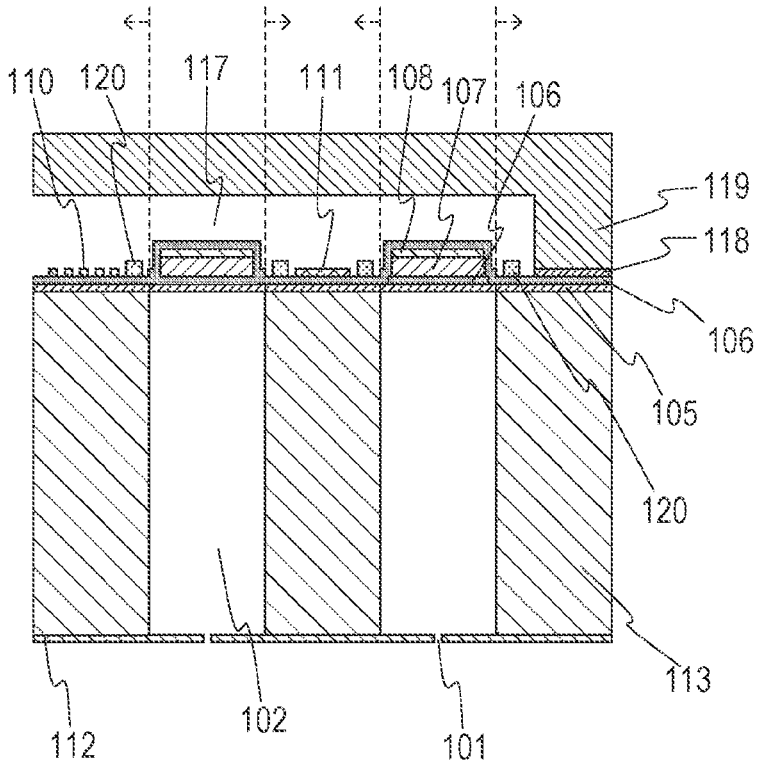
FIG. 3 is a cross-sectional view of a liquid ejection head according to a third example embodiment of the present disclosure.

A third example embodiment will be described with reference to FIG. 3. FIG. 3 is a cross-sectional view taken along line III-III in FIG. 2 illustrating the periphery of the pressure chambers 102 of the inkjet head 100. In the third embodiment, the liquid repellent portion 120 is formed outside the short-side liquid chamber wall of each pressure chamber 102. The piezoelectric elements 107 are each disposed in an area corresponding to the width of the pressure chamber 102. The liquid repellent portion 120 is disposed outside the area.

Since the liquid repellent portion 120 is disposed outside the short-side liquid chamber wall of the pressure chamber 102 which has a large influence on the variations in the driving frequency of the piezoelectric element 107, the liquid repellent portion 120 does not influence the deformation of the diaphragm 105, further reducing the variations in the driving of the piezoelectric element 107. Since the liquid repellent portion 120 can be formed also on the individual lead-out electrodes 110 and the common lead-out electrodes 111, the adjacent pressure chambers 102 can be arranged at necessary minimum intervals. This allows the pressure chambers 102 to be densely disposed and reduces variations in the driving of the piezoelectric elements 107.

In the above embodiments, the liquid repellent portion 120 surround the piezoelectric elements 107. This is given for mere illustrative purposes. The liquid repellent portion 120 may not be disposed in a continuous pattern as described above but may be disposed in an intermittent pattern. The liquid repellent portion 120 may not completely surround the periphery of the piezoelectric elements 107 but may surround at least three sides as illustrated in FIG. 1A.

According to the embodiments of the present disclosure, a liquid repellent made of a material that repels an adhesive is formed around the piezoelectric elements, so that variations in the driving of the piezoelectric elements can be reduced.

While the present disclosure has been described with reference to numerous exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-227970 filed Nov. 28, 2017, which is hereby incorporated by reference herein in its entirety.

What is claimed is:

1. A liquid ejection head comprising:

a first substrate comprising:

a portion forming a pressure chamber configured to be in communication with an ejection port that ejects liquid;

a diaphragm that forms part of a wall constituting the pressure chamber; and at least one piezoelectric element configured to generate energy for displacing the diaphragm to eject liquid through the ejection port;

a second substrate having a portion forming a cavity for containing the at least one piezoelectric element;

adhesive joining the first substrate and the second substrate together; and a liquid repellent portion surrounding, but not in contact with the at least one piezoelectric element, disposed on a surface of the first substrate where the at least one piezoelectric element is disposed.

2. The liquid ejection head according to claim 1, wherein the at least one piezoelectric element comprises a plurality of piezoelectric elements, and wherein the liquid repellent portion is disposed so as to surround the plurality of piezoelectric elements.

3. The liquid ejection head according to claim 1, wherein the at least one piezoelectric element comprises a plurality of piezoelectric elements, and wherein the liquid repellent portion is disposed so as to individually surround each of the plurality of piezoelectric elements.

4. The liquid ejection head according to claim 1, wherein the liquid repellent portion is thicker than the adhesive.

5. The liquid ejection head according to claim 1, wherein the at least one piezoelectric element is disposed in an area corresponding to a width of the pressure chamber, and wherein the liquid repellent portion is disposed outside the area.

6. The liquid ejection head according to claim 1, wherein the liquid repellent portion is disposed continuously.

7. The liquid ejection head according to claim 1, wherein the liquid repellent portion is disposed intermittently.

8. The liquid ejection head according to claim 1, wherein the liquid repellent portion is disposed in the cavity.

9. The liquid ejection head according to claim 1, further comprising:

a third substrate comprising a supply channel for supplying liquid to the pressure chamber, wherein the second substrate and the third substrate are joined together.

10. A liquid ejection head comprising:

a first substrate comprising:

a portion forming a pressure chamber configured to be in communication with an ejection port that ejects liquid;

a diaphragm that forms part of a wall constituting the pressure chamber; and at least one piezoelectric element configured to generate energy for displacing the diaphragm to eject liquid through the ejection port;

a second substrate comprising:

a portion forming a cavity for containing the at least one piezoelectric element; and a junction at which the first substrate and the second substrate are joined together with an adhesive; and a liquid repellent portion surrounding, but not in contact with the at least one piezoelectric element, disposed on a surface of the first substrate where the at least one piezoelectric element is disposed, the liquid repellent portion being disposed between the at least one piezoelectric element and the junction.

11. The liquid ejection head according to claim 10, wherein the liquid repellent portion is thicker than the adhesive.

* * * * *